United States Patent [19]

Henry et al.

[11] 4,216,672

[45] Aug. 12, 1980

[54] APPARATUS FOR DETECTING AND INDICATING THE OCCURRENCE OF A GAS TURBINE ENGINE COMPRESSOR STALL

[75] Inventors: George R. Henry, Loveland; William R. Spencer, Cincinnati, both of Ohio

[73] Assignee: General Electric Company, Cincinnati, Ohio

[21] Appl. No.: 7,118

[22] Filed: Jan. 29, 1979

[51] Int. Cl.[3] ..... G01M 15/00

[52] U.S. Cl. ..... 73/115; 116/267

[58] Field of Search ..... 73/116, 115, 716, 49.7; 340/27 SS; 116/267, 268

[56] References Cited

U.S. PATENT DOCUMENTS

| | | | |
|---|---|---|---|
| 3,564,175 | 2/1971 | Cooper | 200/82 |
| 3,815,542 | 6/1974 | Cooper | 116/70 |
| 3,852,958 | 12/1974 | Adams et al. | 60/39.28 R |
| 3,867,717 | 2/1975 | Moehring et al. | 340/27 SS |
| 4,103,544 | 8/1978 | Beckmann et al. | 73/115 |

*Primary Examiner*—Jerry W. Myracle

*Attorney, Agent, or Firm*—Derek P. Lawrence

[57] ABSTRACT

An apparatus for detecting and indicating the occurrence of a gas turbine engine stall operates by sensing sudden changes in a selected engine pressure. When a sudden large decrease in the selected engine pressure indicative of a stall is sensed, a visual indication is provided.

9 Claims, 4 Drawing Figures

APPARATUS FOR DETECTING AND INDICATING THE OCCURRENCE OF A GAS TURBINE ENGINE COMPRESSOR STALL

BACKGROUND OF THE INVENTION

1. Field of the Invention

This invention relates generally to gas turbine engines and, more particularly, to an apparatus for detecting and indicating the occurrence of a gas turbine engine stall.

2. Description of the Prior Art

As is well known in the art, during the operation of an aircraft gas turbine engine there may occur a phenomenon referred to as stall, wherein a momentary reversing of the airflow occurs through the compressor. This causes the compressor discharge pressure to decay very rapidly, and occasionally results in pressure oscillations through the compressor until corrective action is taken. A stall may result from a variety of reasons such as an engine acceleration which is too rapid, an unduly distorted inlet air temperature or pressure profile, or compressor damage due to the ingestion of foreign objects or malfunctions. The principal cause of stall is aerodynamic overloading of the compressor for the particular rotational speed and inlet temperature at which the engine is operating.

Prior art devices have attempted to sense when a stall was imminent and either warn the engine operator to take corrective action or, as is described in U.S. Pat. No. 3,852,958, assigned to the assignee of the present invention, automatically take corrective action to prevent the occurrence of a stall or to minimize its effects. While these prior art devices have achieved a certain amount of success in avoiding and/or compensating for the effects of a stall they generally are comprised of complex electronic or electrohydraulic components which add unnecessary weight and expense to the engine.

An alternate approach is to design the engine control system so as to avoid the area of engine operation where a stall is likely to occur. Although this approach has been highly successful in avoiding stalls, there are still some occasions where a stall may result. For example, there may be an undetected transient malfunction in the engine control system which may allow a stall in certain circumstances.

The present invention provides an apparatus for detecting and indicating the occurrence of a stall so that corrective action, for example correcting an undetected transient control system malfunction, may be taken.

SUMMARY OF THE INVENTION

It is an object of the present invention to provide a self-contained engine mounted apparatus for detecting and indicating the occurrence of a gas turbine engine stall.

It is a further object of the present invention to provide such an apparatus which is simple, lightweight and inexpensive to produce.

It is yet another object of the present invention to provide such an apparatus which requires no external power for operation.

It is still a further object of the present invention to indicate upon routine inspection whether an unreported stall has actually occurred.

Briefly stated, these objects, as well as additional objects and advantages which will become apparent from the following specification and the appended drawings and claims, are accomplished by the present invention which provides an apparatus for detecting and indicating the occurrence of a gas turbine engine stall. The stall indicator is comprised of a housing having an internal pressure chamber. An expansible chamber is disposed within the internal chamber and means is provided for pressurizing both the internal chamber and the expansible chamber in proportion to a selected engine pressure. Means, responsive to changes in the selected engine pressure are included to establish a pressure differential between the interior and the exterior of the expansible chamber. Indicator means responsive to the pressure differential is provided for indicating the occurrence of a decrease in the selected engine pressure which exceeds a threshold value.

DESCRIPTION OF THE PREFERRED EMBODIMENT

Figure 1:
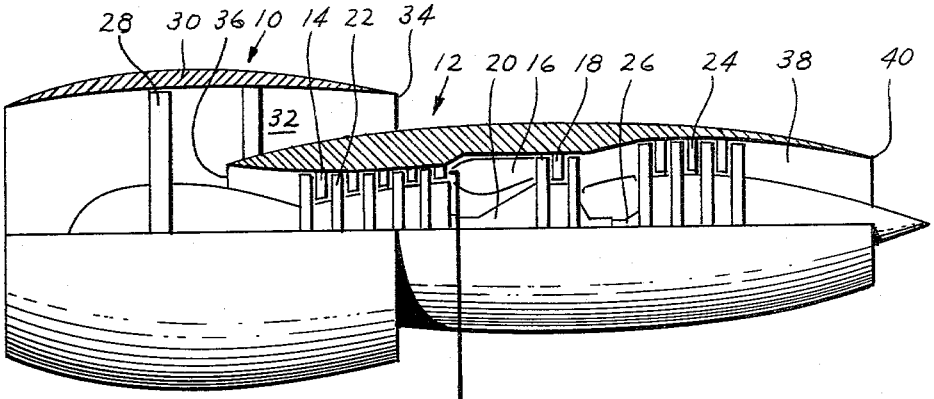
FIG. 1 is a sectional schematical representation of a gas turbine engine which includes an enlarged sectional view of the apparatus of the present invention.
Figure 1:
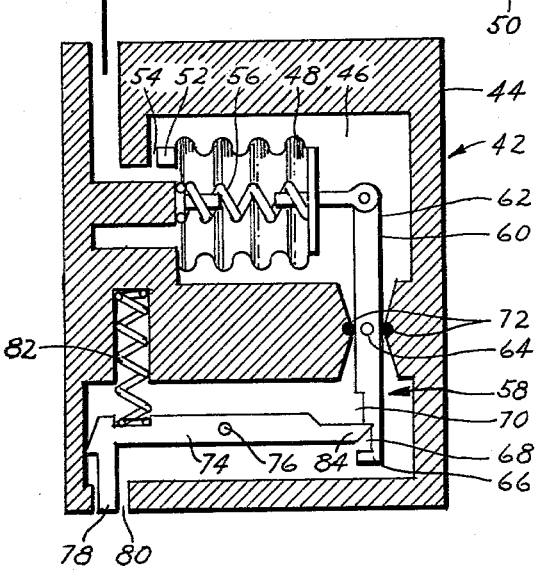

Referring to the drawings, wherein like numerals correspond to like elements throughout, reference is first directed to FIG. 1 wherein a typical gas turbine engine, shown generally as 10, is depicted as including in one form, the present invention. The engine 10 is comprised of a core engine or core 12 which includes in serial flow relationship, an axial flow compressor 14, a combustor 16 and a high pressure turbine 18. The high pressure turbine 18 is drivingly connected to the compressor 14 by a shaft 20 and a core rotor 22. The engine 10 is also comprised of a low pressure system, which includes a low pressure turbine 24 which is drivingly connected by a low pressure shaft 26 to a fan assembly 28. An outer nacelle 30 is spaced apart from the core engine 12 to define a bypass duct 32 therebetween.

In operation, air enters the engine 10 and is initially compressed by the fan assembly 28. A first portion of this compressed fan air enters the bypass duct 32 and is subsequently discharged through a fan bypass nozzle 34 to provide a first propulsive force. The remaining portion of the compressed fan air enters an inlet 36, is further compressed by the compressor 14 and is discharged into the combustor 16 where it is burned with fuel to provide high energy combustion gases. The combustion gases pass through and drive the high pressure turbine 18 which, in turn, drives the compressor 14. The combustion gases subsequently pass through and drive the low pressure turbine 24 which, in turn, drives the fan 28. The combustion gases then pass along an exhaust flow path 38 whereupon they are discharged from a core exhaust nozzle 40 thereby providing a second propulsive force.

The foregoing description is typical of a present-day turbofan engine; however, as will become apparent from the following description, the present invention may also be employed in conjunction with any other type of gas turbine engine, for example a turboprop, turbojet, turboshaft, etc. The above description of the turbofan engine depicted in FIG. 1 is, therefore, merely meant to be illustrative of one such application of the present invention.

The preferred embodiment of the present invention, shown generally in FIG. 1 as 42, is an apparatus for detecting and indicating the occurrence of a compressor stall during the operation of the engine 10. The apparatus 42 (hereinafter referred to as the stall indicator), operates by sensing any sudden decrease or decay of the discharge pressure from the compressor 14 (hereinafter referred to as CDP) and providing an indication when the rate of any decrease in CDP exceeds a preestablished threshold rate. CDP was chosen for this embodiment of the stall indicator 42 because it is generally the highest readily available pressure level within the engine 10 and, therefore, offers the greatest measurable pressure decrease during a stall. However, the use of CDP or of any other compressor pressure is not intended as a limitation upon the scope of the present invention which may utilize any other convenient source of pressure whose variation is indicative of a stall. Therefore, the terms CDP or compressor pressure are intended to include within their meaning such other sources of pressure.

More specifically, the preferred embodiment of the stall indicator 42 is comprised generally of a housing 44 having an internal pressure chamber 46. Disposed within the internal pressure chamber 46 is a smaller expansible chamber or bellows 48. Both the internal chamber 46 and the bellows 48 are connected to the discharge of the compressor 14 by a conduit 50. Although, in this embodiment, the conduit 50 is depicted as being connected directly to the discharge of the compressor 14, it should be understood that this is not intended to be limiting and the conduit 50 may alternatively be connected to any other suitable source of CDP, as for example, an existing CDP control line.

The conduit 50 provides a means for pressurizing the internal chamber 46 and the interior of the bellows 48 in proportion to the CDP. Thus, as the CDP changes, the pressure within the internal chamber 46 and the interior of the bellows 48 changes correspondingly. In order to detect sudden changes in the CDP, a restrictor means or restrictor 52 is disposed at the entrance of the internal chamber 46. The restrictor 52 establishes a reduced sized orifice 54 to limit the rate of pressure changes within the internal chamber 46. Thus, pressure changes within the internal chamber 46 always lag pressure changes within the bellows 48 and any sudden change in CDP creates a transient pressure differential ($\Delta P$) between the interior of the bellows 48 and the internal chamber 46 (exterior of the bellows). The degree by which the internal chamber pressure changes lag the pressure changes within the bellows 48, and therefore the size and duration of the $\Delta P$ created by a change in the CDP, is a function of the size of the entrance orifice 54 and the volume of the internal chamber 46.

A $\Delta P$ created by a sudden change in the CDP may cause the bellows 48 to either expand or contract, depending upon the magnitude of the change in the CDP and whether the CDP has increased or decreased. For example, after the engine 10 reaches a steady-state condition in which the pressures within the bellows 48 and the internal chamber 46 are essentially equal, a sudden large decrease in the CDP (which is indicative of a stall) results in a correspondingly sudden large decrease in the pressure within the bellows 48. Due to the reduced size of the entrance orifice 54, the pressure decrease within the internal chamber 46 is not as rapid as the decrease of the bellows internal pressure and, for a limited period of time, the pressure within the internal chamber 46 is greater than the pressure within the bellows 48. The greater pressure upon the outside of the bellows 48 tends to cause the bellows 48 to contract to the left as viewed on FIG. 1.

As hereinbefore described, a sudden large decrease in CDP (on the order of 4,000 psi per second) is indicative of a compressor stall. A substantially smaller rate of decrease in CDP could be indicative of numerous nonstall engine operations, for example, throttle chops or combustor blow outs during normal engine shutdowns. A first resilient means or compression spring 56 located within the bellows 48 is preloaded to prevent the contraction of the bellows 48 unless a decrease in CDP exceeds a threshold value, resulting in a large $\Delta P$ between the interior and the exterior of the bellows 48. The threshold value is determined by adjusting the preload of the spring 56 through the use of shims (not shown) or any other method which is known to those skilled in the art. By setting the threshold value high enough, only actual compressor stalls cause the bellows 48 to contract. A test port (not shown) may be utilized to pressurize the internal chamber 46 in order to accurately measure the threshold value.

An indicator means, shown generally as 58, responsive to the movement of the bellows 48 operates in the manner of a firearm to indicate a decrease in CDP which exceeds the threshold value. The indicator means 58 is comprised of an elongated trigger member 60, a first end 62 of which engages the bellows 48. The trigger member 60 is pivotably disposed for rotation about a pivot 64 in response to the movement of the bellows 48. A second end 66 of the trigger member 60 includes a pair of notches 68 and 70, the purpose of which will hereinafter become apparent. A pivot seal 72 or other similar device known to those skilled in the art engages the trigger member 60 proximate to the pivot 64 in order to prevent the leakage of high pressure air from the internal chamber 46.

A hammer member 74 is disposed for rotation about a pivot 76. The hammer member includes an indicator button 78 which is aligned with a slightly larger external opening 80 in the housing 44. A second resilient means or compression spring 82 is preloaded to apply a force which tends to rotate the hammer member 74 about the pivot 76 in such a manner as to cause the indicator button 78 to extend through the external housing opening 80 when a stall has occurred.

During normal engine operation, one end 84 of the hammer member 74 engages the notch 68 on the trigger member 60 in order to prevent rotation of the hammer member 74. When a compressor stall occurs, the contraction of the bellows 48 causes the trigger member 60 to rotate in a counterclockwise direction about pivot 64, thereby moving trigger member end 62 to the left and trigger member end 66 to the right as viewed in FIG. 1. With the rightward movement of trigger member end 66, the hammer member end 84 becomes disengaged from the trigger member notch 68.

Figure 2:
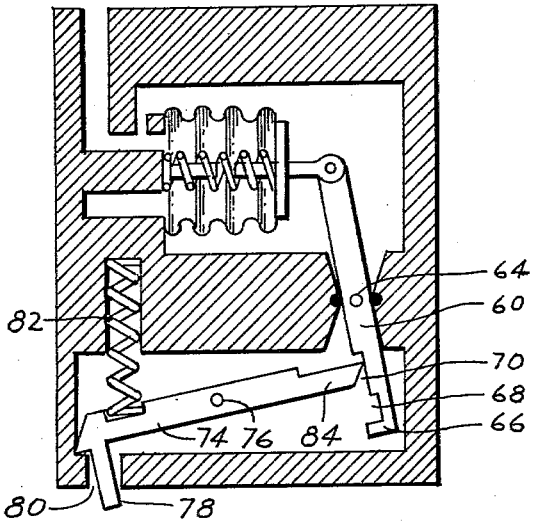
FIG. 2 is an additional view of the indicator portion of FIG. 1 after a stall has occurred.

Once the hammer member end 84 is free from the notch 68 the preload of the spring 82 causes the hammer member 74 to rotate in a counterclockwise direction, thereby extending the indicator button 78 through the external housing opening 80 (as shown in FIG. 2) to provide a visual indication that a stall has occurred. The indicator button 78 remains in its extended position until it is reset by manually depressing it back into the housing 44 during a routine engine inspection or engine maintenance.

ALTERNATE EMBODIMENT

Figure 3:
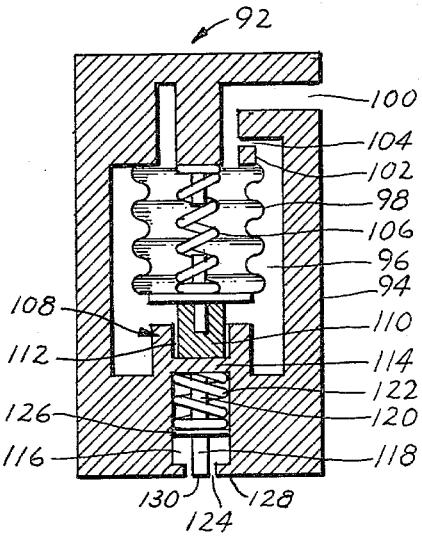
FIG. 3 is a sectional view of an alternate embodiment of the present invention.

Referring now to FIG. 3, there is depicted an alternate embodiment of the present invention (shown generally as 92), which may be employed with the engine depicted in FIG. 1 and described in detail in the foregoing preferred embodiment. The construction and operation of much of this alternate embodiment is substantially the same as or similar to that of the foregoing preferred embodiment. The stall indicator 92 is comprised generally of a non-magnetic housing 94 having an internal pressure chamber 96. Disposed within the internal pressure chamber 96 is a smaller expansible chamber or bellows 98. For reasons discussed in detail in the foregoing preferred embodiment, both the internal chamber 96 and the bellows 98 are connected to a source of compressor discharge pressure (CDP) by means of a conduit 100.

The conduit 100 provides a means for pressurizing the internal chamber 96 and the interior of the bellows 98 in proportion to the CDP. A restrictor means or restrictor 102 is disposed at the entrance of the internal chamber 96, thereby establishing a reduced sized orifice 104 to limit the rate of pressure changes within the internal chamber 96. Thus, pressure changes within the internal chamber 96 always lag pressure changes within the bellows 98. Any change in CDP creates a transient pressure differential ($\Delta P$) between the interior and the exterior of the bellows 98, thereby causing the bellows 98 to either expand or contract.

As described in greater detail in the foregoing preferred embodiment, a sudden large decrease in CDP is indicative of a compressor stall. A smaller decrease in CDP may be indicative of numerous non-stall engine operations. Therefore, a first resilient means or compression spring 106 is disposed within the bellows 98 with a preload which prevents the contraction of the bellows 98 unless a decrease in CDP exceeds a threshold value. As described in detail in the foregoing preferred embodiment, the threshold value is set high enough so that the bellows 48 contracts only if an actual compressor stall occurs.

An indicator means, (shown generally as 108) responsive to the movement of the bellows 98 indicates a decrease in CDP which exceeds the threshold value. The indicator means 108 is comprised of a magnetic piston 110 which engages the bellows 98. The magnetic piston 110 is disposed within a chamber 112 and moves therein in accordance with the movement of the bellows 98. A small partition 114 of non-magnetic material separates chamber 112 from a second annular chamber 116. Within the second chamber 116 is disposed an annular indicator button 118 having magnetic material on at least a first end 120 thereof. During normal engine operation the indicator button end 120 is located proximate to the magnetic piston 110 and is retained by magnetic attraction in the position shown in FIG. 3. A second resilient means or compression spring 122 is preloaded to apply a force which tends to push the indicator button 118 through an annular opening 124 in the housing 94.

During normal engine operation, the bellows 98 remains in an expanded condition due to the preload of compression spring 106. As long as the bellows 98 remains in this expanded position, the magnetic piston 110 remains adjacent to the partition 114. Since the magnetic gap between the magnetic piston 110 and the magnetic material on indicator button end 120 is small, the magnetic attraction between them is enough to overcome the preload of compression spring 122 and the indicator button 118 is retained in place within the housing 94.

Figure 4:
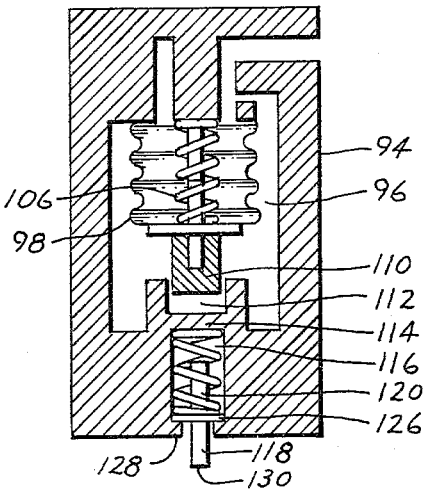
FIG. 4 is an additional view of the indicator portion of FIG. 3 after a stall has occurred.

When a compressor stall occurs, the bellows 98 contracts, thereby moving the magnetic piston 110 upward as depicted in FIG. 4. As the size of the magnetic gap between the magnetic piston 110 and the magnetic material on indicator button end 120 increases due to the upward movement of the magnetic piston 110, the magnetic attraction between them decreases until it is not strong enough to overcome the preload of the spring 122. Once the preload of the spring 122 exceeds the magnetic attraction, the indicator button 118 moves downward as shown in FIG. 4. A return to normal engine operation subsequent to a stall does not result in the indicator button 118 being returned to its original location within chamber 116 since the magnetic gap between the magnetic piston 110 and the indicator button end 120 remains too large for the magnetic attraction forces to overcome the force of spring 122.

An annular flange 126 on the indicator button 118 engages an annular flange 128 surrounding the annular housing opening 124 in order to retain a portion of the indicator button within chamber 116. A second end 130 of the indicator button 118 extends outside of the housing 94 to provide a visual indication that a compressor stall has occurred. The indicator button end 130 remains in its extended position until it is reset by manually depressing it back into the housing 94 during a routine engine inspection or engine maintenance procedures.

From the foregoing descriptions it can be seen that the present invention comprises a self-contained, engine-mounted apparatus for detecting and indication upon a routine ground inspection of the occurrence of a gas turbine engine stall. The apparatus is simple, lightweight, inexpensive to produce and requires no external power for operation. It will be recognized by one skilled in the art that changes may be made to the above-described invention without departing from the broad inventive concepts thereof. For example, a piston may be employed instead of the bellows 48 (98) or O-rings may be employed on the bellows 48 (98) to provide damping in order to minimize the effects of engine vibration. It is to be understood, therefore, that this invention is not limited to the particular embodiments disclosed, but it is intended to cover all modifications which are within the spirit and the scope of the invention as set forth in the appended claims.

What is claimed is:

1. In a gas turbine engine including a compressor, an apparatus for detecting and indicating the occurrence of a stall comprising:

a housing having an internal pressure chamber;

a discrete expansible chamber disposed within the internal pressure chamber;

means for pressurizing the internal pressure chamber and the interior of the expansible chamber in proportion to a selected engine pressure;

means responsive to changes in the selected engine pressure for establishing a pressure differential between the interior and the exterior of the expansible chamber; and indicator means responsive to said pressure differential for indicating the occurrence of a sudden decrease in the selected engine pressure which exceeds a threshold value.

2. The apparatus as recited in claim 1 wherein the selected engine pressure utilized is the pressure at the discharge of the compressor.

3. The apparatus as recited in claim 1 wherein the expansible chamber is a bellows.

4. In a gas turbine engine including a compressor, an apparatus for detecting and indicating the occurrence of a stall comprising:

a housing having an internal pressure chamber;

an expansible chamber disposed within the internal pressure chamber;

means for pressurizing the internal pressure chamber and the interior of the expansible chamber in proportion to a selected engine pressure;

restrictor means responsive to changes in the selected engine pressure for establishing a pressure differential between the interior and the exterior of the expansible chamber and for limiting the rate of pressure changes within the internal pressure chamber; and indicator means responsive to said pressure differential for indicating the occurrence of a sudden decrease in the selected engine pressure which exceeds a threshold value.

5. In a gas turbine engine including a compressor, an apparatus for detecting and indicating the occurrence of a stall comprising:

a housing having an internal pressure chamber;

an expansible chamber disposed within the internal pressure chamber;

means for pressurizing the internal pressure chamber and the interior of the expansible chamber in proportion to a selected engine pressure;

means responsive to changes in the selected engine pressure for establishing a pressure differential between the interior and the exterior of the expansible chamber; and a trigger member, responsive to said pressure differential for indicating the occurrence of a sudden decrease in the selected engine pressure which exceeds a threshold value, engaging the expansible chamber and disposed for movement within the housing, said trigger member moving in a first direction only when the pressure differential exceeds the threshold value; and means for indicating when the trigger member has moved in the first direction.

6. The apparatus as recited in claim 5 wherein the trigger member moves in said first direction upon the contraction of the expansible chamber.

7. In a gas turbine engine including a compressor, an apparatus for detecting and indicating the occurrence of a stall comprising:

a housing having an internal pressure chamber and an external opening;

an expansible chamber disposed within the internal pressure chamber;

means for pressurizing the internal pressure chamber and the interior of the expansible chamber in proportion to a selected engine pressure;

means responsive to changes in the selected engine pressure for establishing a pressure differential between the interior and the exterior of the expansible chamber; and indicator means, responsive to said pressure differential for indicating the occurrence of a sudden decrease in the selected engine pressure which exceeds a threshold value, comprising first resilient means for preventing the contraction of the expansible chamber unless a sudden decrease in the selected engine pressure exceeds the threshold value;

a magnetic piston engaging the expansible chamber for movement upon the contraction of the expansible chamber;

an indicator button having magnetic material on at least a first end thereof, said first end being located proximate to and being subject to the magnetic attraction of the magnetic piston during normal engine operation; and second resilient means engaging the indicator button for causing a second end of the indicator button to extend through the external housing opening upon the contraction of the expansible chamber.

8. In a gas turbine engine including a compressor, an apparatus for detecting and indicating the occurrence of a compressor stall, comprising:

a housing having an internal pressure chamber and an external opening;

a bellows disposed within the internal pressure chamber;

means for pressurizing the internal pressure chamber and the interior of the bellows in proportion to the compressor discharge pressure;

restrictor means for limiting the rate of pressure changes within the internal pressure chamber, to establish a transient pressure differential between the interior and the exterior of the bellows;

first resilient means for preventing the contraction of the bellows unless a sudden decrease in the compressor discharge pressure exceeds a threshold value;

a trigger member engaging the bellows and pivotably disposed for rotation within the housing in response to the contraction of the bellows, said trigger member including a notch thereon;

a hammer member pivotably disposed for rotation within the housing, said hammer member having a first end which engages the trigger member notch to prevent rotation of the hammer member during normal engine operation, said first end being disengaged from said notch upon the rotation of the trigger member;

second resilient means engaging the hammer member for causing the hammer member to rotate when said first end is disengaged from said notch; and an indicator button disposed upon the hammer member, said button extending through the external housing opening upon the rotation of the hammer member.

9. In a gas turbine engine including a compressor, an apparatus for detecting and indicating the occurrence of a compressor stall, comprising:

a nonmagnetic housing having an internal pressure chamber and an external opening;

a bellows disposed within the internal pressure chamber;

means for pressurizing the internal pressure chamber and the interior of the bellows in proportion to the compressor discharge pressure;

restrictor means for limiting the rate of pressure changes within the internal pressure chamber, to establish a transient pressure differential between the interior and the exterior of the bellows;

first resilient means for preventing the contraction of the bellows unless a sudden decrease in the compressor discharge pressure exceeds a threshold value;

a magnetic piston engaging the bellows for movement upon the contraction of the bellows;

an indicator button having magnetic material on at least a first end thereof, said first end being located proximate to and being subject to the magnetic attraction of the magnetic piston during normal engine operation; and second resilient means engaging the indicator button for causing a second end of the indicator button to extend through the external housing opening upon the contraction of the expansible chamber.

* * * * *